US008641032B2

(12) United States Patent
Nakamura et al.

(10) Patent No.: US 8,641,032 B2
(45) Date of Patent: Feb. 4, 2014

(54) RECORDING DEVICE

(75) Inventors: Kazuhisa Nakamura, Matsumoto (JP); Atsuhiko Takeuchi, Matsumoto (JP); Kazumasa Harada, Matsumoto (JP); Kensuke Tamai, Shiojiri (JP); Kazutoshi Matsuzaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

(21) Appl. No.: 13/361,245

(22) Filed: Jan. 30, 2012

(65) Prior Publication Data

US 2012/0195669 A1 Aug. 2, 2012

(30) Foreign Application Priority Data

Feb. 1, 2011 (JP) ..... 2011-020176

(51) Int. Cl.
*B65H 3/44* (2006.01)

(52) U.S. Cl.
USPC ..... 271/9.05; 271/9.08; 271/9.11; 271/164; 271/213

(58) Field of Classification Search
USPC ..... 271/9.01, 3.14, 9.05, 9.07, 9.08, 9.11, 271/9.13, 213, 163, 164
See application file for complete search history.

(56) References Cited

U.S. PATENT DOCUMENTS

| | | | | |
|---|---|---|---|---|
| 5,127,646 | A * | 7/1992 | Matsuda et al. | 271/171 |
| 7,654,515 | B2 * | 2/2010 | Koga | 271/9.08 |
| 7,677,548 | B2 * | 3/2010 | Chino | 271/9.11 |
| 2006/0261535 | A1 | 11/2006 | Shiohara et al. | |
| 2007/0075477 | A1 | 4/2007 | Shiohara | |

FOREIGN PATENT DOCUMENTS

| | | |
|---|---|---|
| JP | 2006-273565 | 10/2006 |
| JP | 2006-273567 | 10/2006 |
| JP | 2007-091445 | 4/2007 |

* cited by examiner

*Primary Examiner* — Michael McCullough
(74) *Attorney, Agent, or Firm* — Workman Nydegger

(57) ABSTRACT

A sheet cassette includes a lower stage side tray that accommodates a sheet, an upper stage side tray that is slidable with respect to the lower stage side tray on an upper portion of the lower stage side tray and accommodates the sheet, and a discharged sheet tray that is slidable with respect to the upper stage side tray, is displaceable to a position to receive the sheet discharged after being recorded on, and covers an upper portion of the upper stage side tray. The upper stage side tray and the discharged sheet tray are configured to be driven by a driving unit, and the discharged sheet tray is displaced by the driving unit to a position to receive the sheet.

2 Claims, 5 Drawing Sheets

RECORDING DEVICE

BACKGROUND

1. Technical Field

The present invention relates to a recording device including a recording medium cassette that accommodates the recording medium.

2. Related Art

In a recording device represented by a facsimile and a printer, sheet cassettes that are detachable with respect to a device main body have been widely used. In addition, among these, as disclosed in JP-A-2006-273565 and JP-A-2007-91445, a sheet cassette having a two-stage structure, which includes sheet accommodating portions at a lower stage and an upper stage in one detachable sheet cassette (tray), is disclosed. In addition, in the recording device, as a name of the sheet accommodating portion that accommodates sheets, various names such as "cassette" and "tray" are exemplified, but in this specification, the entirety of one unit body that is detachable with respect to a device main body is referred to as a "cassette", and a plurality of sheet accommodating portions that is provided in the cassette is referred to as a "tray".

The recording device disclosed in JP-A-2006-273565 and JP-A-2007-91445 is configured in such a manner that a discharged sheet receiving portion that receives a sheet on which recording is performed also functions as the upper stage tray. That is, the upper stage tray is configured in such a manner that a position that is retreated so as not to make a disturbance when transmitting a sheet from the lower stage tray, and a position that is advanced when transmitting a sheet from the upper stage tray are newly changed by an operation of a user. The sheet that is transmitted from the lower stage tray and is subjected to the recording is received at the above-described retreated position.

However, the user needs to operate the upper stage tray in each case as described above, such that it is difficult to say that usability is always high.

SUMMARY

An advantage of some aspects of the invention is to further improve the operability of a sheet cassette having a discharged sheet receiving function of receiving a sheet that is discharged after being recorded on.

According to a first aspect of the invention, there is provided a recording device including a recording medium cassette that includes a cassette main body that accommodates the recording medium, and a recording medium receiving member that is slidable with respect to the cassette main body on an upper portion of the cassette main body and that is displaceable to a position to receive the recording medium discharged after being recorded on; and a driving unit which allows the recording medium receiving member to slide.

According to this aspect, since the recording medium receiving member, which is displaceable to a position to receive the recording medium discharged after being recorded on, is driven by the driving unit, it is possible to receive the discharged recording medium by the recording medium receiving member without needing a user operation, such that operability of the recording medium cassette may be further improved.

According to a second aspect of the invention, there is provided a recording device including a recording medium cassette that includes a lower stage side tray that accommodates a recording medium, an upper stage side tray that is slidable with respect to the lower stage side tray on an upper portion of the lower stage side tray and accommodates the recording medium, and a recording medium receiving member that is slidable with respect to the upper stage side tray on an upper portion of the upper stage side tray and is displaceable to a position to receive the recording medium discharged after being recorded on; and a driving unit which allows the recording medium receiving member to slide.

According to this aspect, similarly to the first aspect, since the recording medium receiving member, which is displaceable to a position to receive the recording medium discharged after being recorded on, is driven by the driving unit, it is possible to receive the discharged recording medium by the recording medium receiving member without needing a user operation, such that operability of the recording medium cassette may be further improved.

In a third aspect of the invention according to the second aspect, the driving unit may be configured to allow the upper stage side tray and the recording medium receiving member to slide in conjunction with each other.

According to this aspect, since the driving unit that drives the recording medium receiving member is configured to allow the upper stage side tray and the recording medium receiving member to slide in conjunction with each other, it is possible to make a structure of a driving mechanism simple and thereby to configure the driving mechanism at a low cost compared to a case in which mechanisms, which independently drive the upper stage side tray and the recording medium receiving member, are provided.

In a fourth aspect of the invention according to the third aspect, a controller, which controls the driving unit, may position the recording medium receiving member in response to a length of the recording medium that is transmitted from the lower stage side tray or the upper stage side tray.

According to this aspect, since the controller, which controls the driving unit, positions the recording medium receiving member in response to a length of the recording medium that is transmitted from the lower stage side tray or the upper stage side tray, the recording medium receiving member is positioned to an appropriate position in response to the length of the transmitted recording medium, such that it is possible to appropriately receive the discharged recording medium by the recording medium receiving member.

In a fifth aspect of the invention according to the third aspect, the driving unit may include a rotator from which the driving unit obtains power from a motor, a first pinion gear that engages with a first rack formed along a sliding direction of the upper stage side tray and obtains power from the rotator through a friction force, and a second pinion gear that engages with a second rack formed along a sliding direction of the recording medium receiving member, and obtains power from the rotator.

According to this aspect, the first pinion gear that drives the upper stage side tray is configured to obtain the power from the motor through friction force, even when an amount of rotation that is necessary to the first pinion gear driving the upper stage side tray and an amount of rotation that is necessary to the second pinion gear driving the recording medium receiving member are different from each other, the first pinion gear may revolve with respect to the rotator, such that the difference in the amount of rotation may be absorbed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
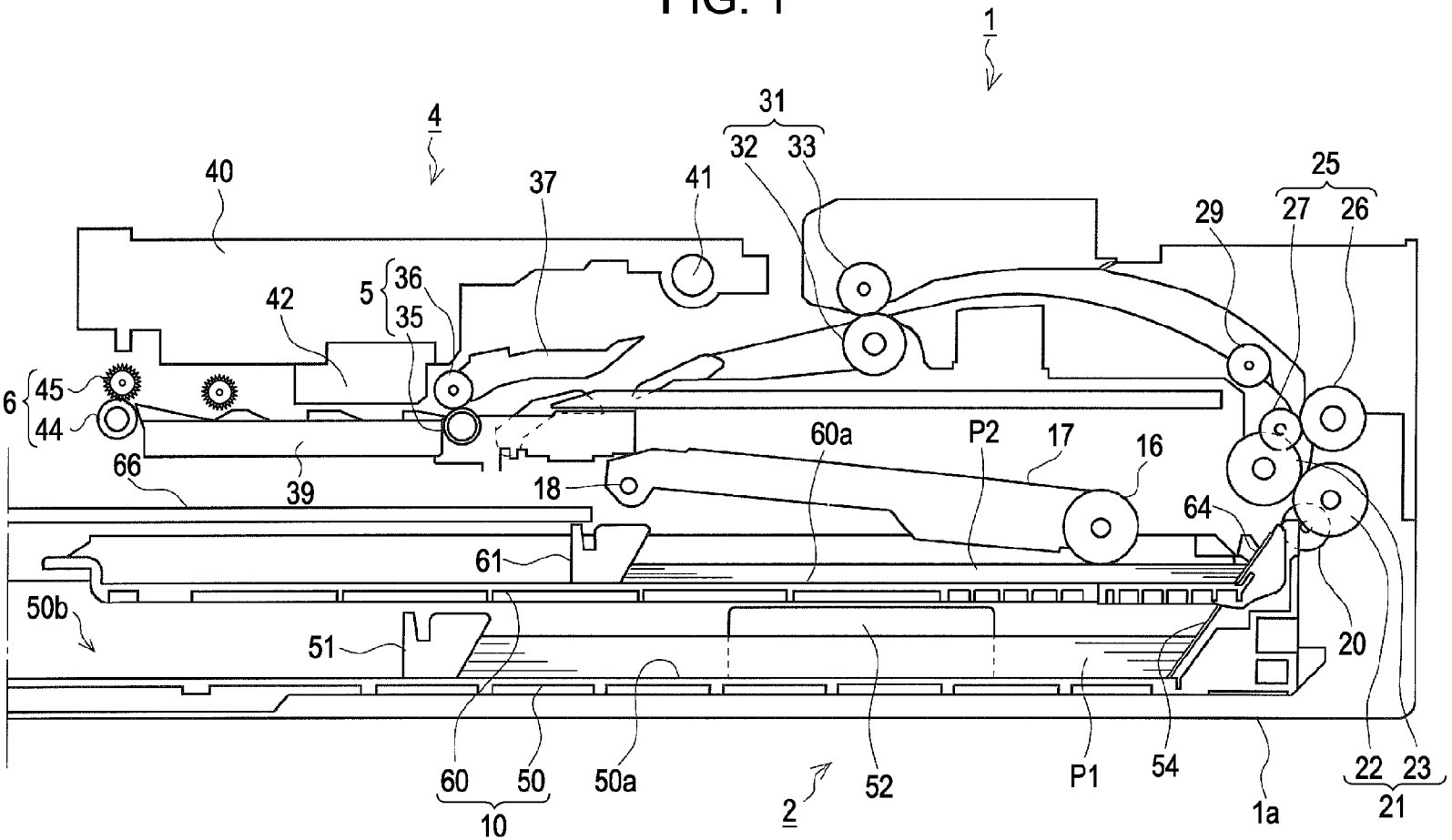
FIG. 1 is a side cross-sectional view illustrating a sheet transporting path of a printer according to an embodiment of the invention.
Figure 2:
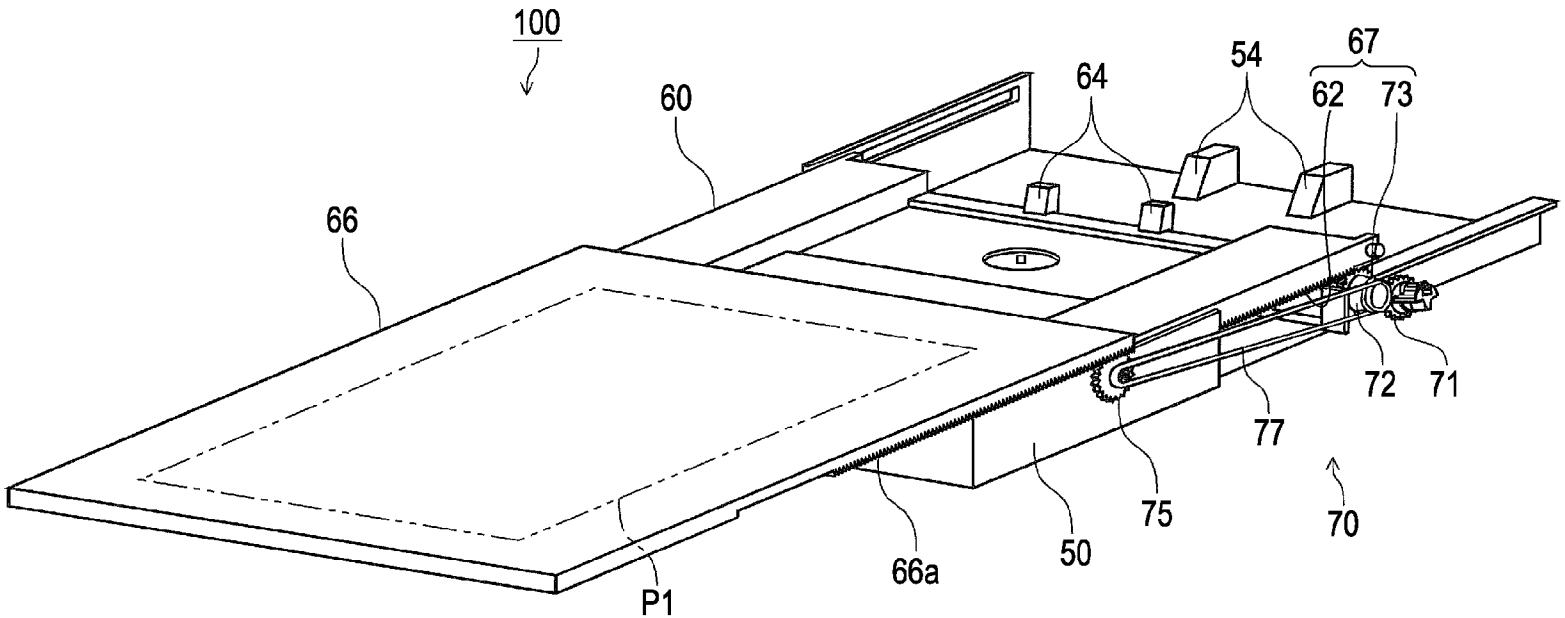
FIG. 2 is a perspective view of a sheet cassette (sheet feeding state from a lower stage side tray).
Figure 3:
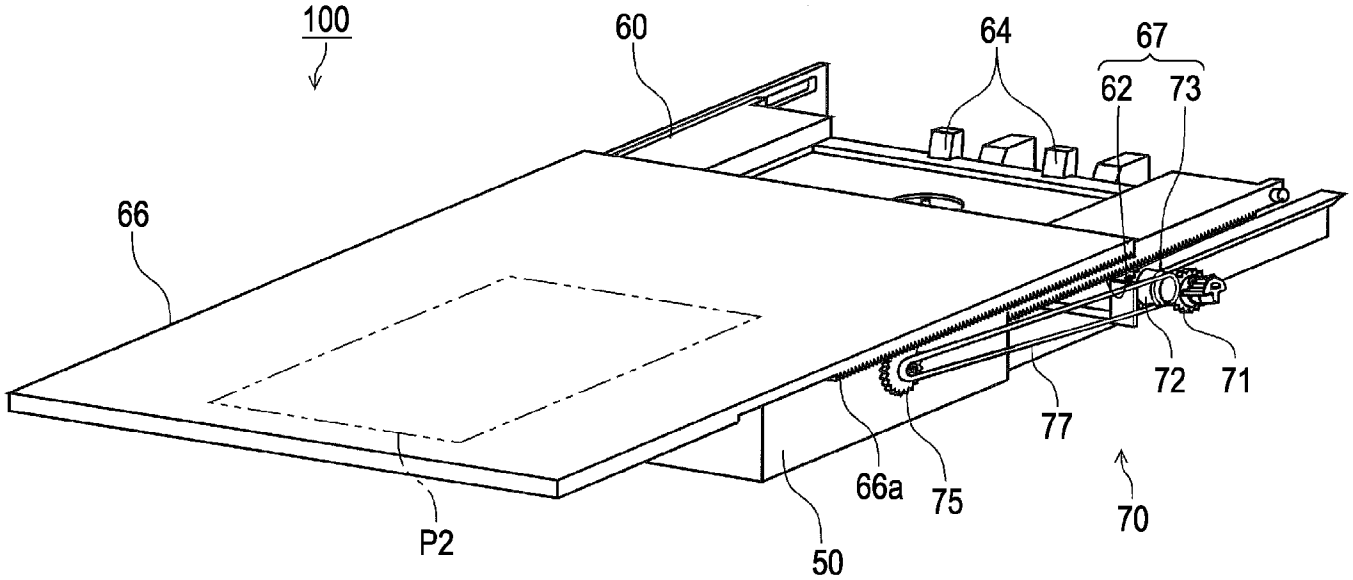
FIG. 3 is a perspective view of a sheet cassette (sheet feeding state from an upper stage side tray).
Figure 4:
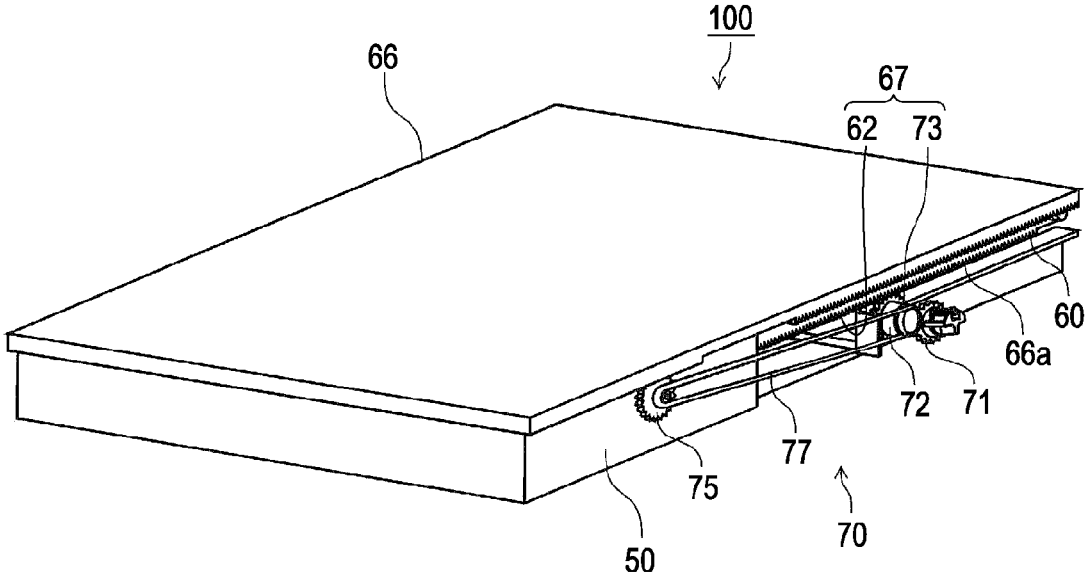
FIG. 4 is a perspective view of a sheet cassette (a completely closed state).

Hereinafter, an embodiment of the invention will be described with reference to FIGS. 1 to 5. FIG. 1 shows a side cross-sectional view illustrating a sheet transporting path of an ink jet printer (hereinafter, referred to as "printer") 1 that is an embodiment of the "recording device" related to the invention. FIGS. 2 to 4 show perspective views of a sheet cassette 100, in which FIG. 2 illustrates a state in which the sheet is fed from a lower stage side tray 50 (an upper stage side tray 60 is located in a withdrawal region), FIG. 3 illustrates a state in which the sheet is fed from the upper stage side tray 60 (the upper stage side tray 60 is located in a region at which feeding is possible), and FIG. 4 illustrates a completely closed state (for example, a state in which a sheet cassette 100 is detached from the printer 1), respectively.

Figure 5:
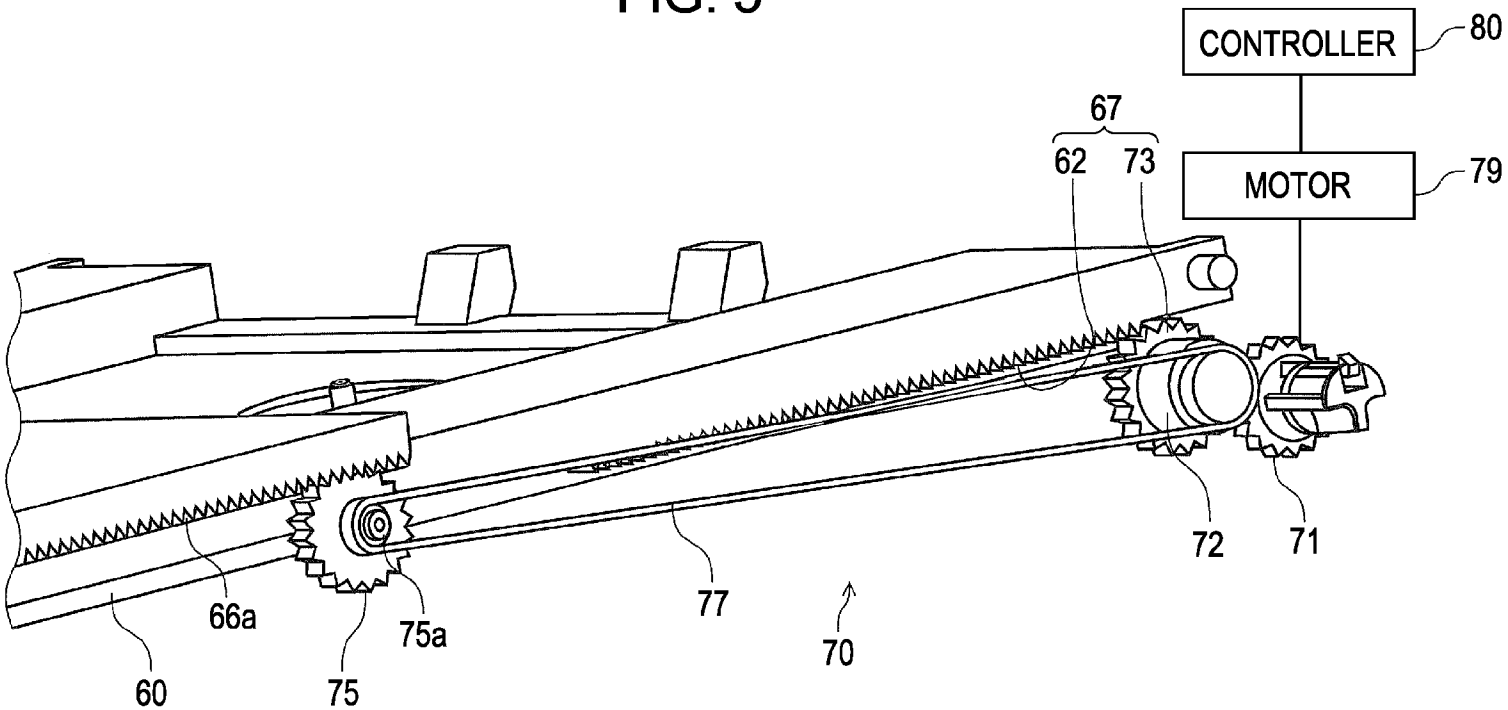
FIG. 5 is a perspective view of a driving unit that drives a discharged sheet tray and the upper stage side tray.

In addition, particularly, FIGS. 2 and 3 illustrate a state of the sheet cassette 100 when the sheet cassette 100 is mounted in a device main body 1*a* of the printer 1, but components at the side of the device main body 1*a* are omitted, and only the sheet cassette 100 and a driving unit 70 described later are illustrated. In addition, FIGS. 2 to 4 illustrate a positional relationship of the lower stage side tray 50, the upper stage side tray 60, and a discharged sheet tray 66, and each component is schematically (simply) illustrated. In addition, FIG. 5 is a perspective view of the driving unit 70 that drives the discharged sheet tray 66 and the upper stage side tray 60.

Hereinafter, an entire configuration of the printer 1 will be schematically illustrated with reference to FIG. 1. The printer 1 includes a feeding device 2 at a lower side thereof. Basically, the printer 1 feeds a sheet (mainly a cut sheet) that is an example of the "recording medium" from the feeding device 2 sheet by sheet, performs a recording (ink jet recording) at a recording unit 4, and discharges the sheet toward a discharged sheet stacker (not shown) provided at the front side of the device (left side in FIG. 1).

Hereinafter, components on a sheet transporting path will be described in more detail.

The feeding device 2 includes the sheet cassette 100, a pickup roller 16, a guide roller 20, and a separating unit 21.

The sheet cassette 100 in which a plurality of sheets P may be set in a stacked state is detachably mounted with respect to the device main body 1*a* of the feeding device 2 from a device front side. The sheet cassette 100 includes two sheet accommodating portions, that is, the lower stage side tray 50 that is located at a lower side of the sheet cassette 100 and makes up a base thereof, and the upper stage side tray 60 that is located at an upper side of the sheet cassette 100 and is slidable between a feedable position and a withdrawn region along a sheet feeding direction. In addition, the discharged sheet tray 66 as a recording medium receiving member, which also functions as a cover member that covers a sheet accommodating space of the upper stage side tray 60, is provided on an upper portion of the upper stage side tray 60 to be slidable with respect to the upper stage side tray 60 along the sheet feeding direction (in other words, along a sheet discharging direction).

In addition, in FIGS. 1 and 2, a sheet accommodated in the lower stage side tray 50 is designated by a reference numeral P1 and a sheet accommodated in the upper stage side tray 60 is designated by a reference numeral P2, respectively (hereinafter, when it is not necessary to particularly discriminate these sheets, these sheets are referred to as "sheet P").

The lower stage side tray 50 includes an edge guide 51 that is slidable in the sheet feeding direction (that is, a longitudinal direction of the sheet) at the bottom surface 50*a* thereof, and a position of a rear end edge is regulated by the edge guide 51. In addition, an edge guide 52 that is slidable in a direction (that is, a width direction of the sheet) orthogonal to the sheet feeding direction is also provided, and a position of a side edge of the sheet P1 is regulated by the edge guide 52.

On the other hand, the upper stage side tray 60 includes an edge guide 61 that is slidable in the longitudinal direction of the sheet and an edge guide (not shown) that is slidable in the width direction of the sheet are provided at the bottom surface 60*a* thereof, similarly to the lower stage side tray 50.

Next, the pickup roller 16 that is rotatably driven by a motor (not shown) is provided to a swing member 17 that swings around a swing shaft 18. When the upper stage side tray 60 is in a state of being slid to the most rear side (in FIG. 1, a left direction: a drawing direction side of the sheet cassette 100), that is, when the upper stage side tray 60 is in a withdrawn region, the pickup roller 16 rotates while being brought into contact with the uppermost sheet P1 accommodated in the lower stage side tray 50, and transmits the uppermost sheet P1 from the lower stage side tray 50.

In addition, when the upper stage side tray 60 is at a position where the upper stage side tray 60 slides to the most front side of the device and abuts thereon (in FIG. 1, a right direction: amounting direction side of the sheet cassette 100), that is, at a feedable position of the upper stage side tray 60, the pickup roller 16 rotates while being brought into contact with the uppermost sheet P2 accommodated in the upper stage side tray 60, and transmits the uppermost sheet P2 from the upper stage side tray 60.

Reference numerals 54 and 64 represent separation inclined planes of the lower stage side tray 50 and the upper stage side tray 60, respectively, and the sheet transmitted from each tray is fed while the front end thereof comes into contact with the separation inclined plane 54 or the separation inclined plane 64, such that the forwarding of sheets (sheets that are apt to be double-fed) on and after the next sheet is prohibited.

Next, a freely rotatable guide roller 20 is provided at a downstream side of the separation inclined planes 54 and 64, and a separating unit 21 including a separating roller 22 and a driving roller 23 is provided at a downstream side of the guide roller 20. An outer circumferential surface of the separating roller 22 is formed of an elastic material and the separating roller 22 is provided to be brought into press-contact with the driving roller 23. In addition, the separation roller 22 is provided at a state where a predetermined rotational resistance is given by a torque limiter mechanism. Therefore, the sheets P on and after the next sheet, which are apt to be double-fed are interrupted at a position between the separating roller 22 and the driving roller 23, that is, a double feeding is prevented. In addition, the driving roller 23 is driven to rotate in a direction to feed the sheet P to a downstream side by a motor (not shown).

A first intermediate feeding portion 25, which includes a driving roller 26 that is driven to rotate by a motor (not shown)

and an assist roller 27 that is driven-rotated with the sheet P being nipped between the driving roller 26 and the assist roller 27, is provided at a downstream side of the separating unit 21, and the sheet P is fed to a further downstream side by the first intermediate feeding portion 25. In addition, a reference numeral 29 indicates a driven roller that mitigates a load that is transmitted through the sheet P when the sheet P passes through a curved inversion path (particularly, a rear end of the sheet P passes through the curved inversion path).

A second intermediate feeding portion 31, which includes a driving roller 32 that is driven to rotate by a motor (not shown) and an assist roller 33 that is driven-rotated with the sheet P being nipped between the driving roller 32 and the assist roller 33, is provided at a downstream side of the driven roller 29, and the sheet P is fed to a further downstream side by the second intermediate feeding portion 31.

The recording unit 4 is disposed at a downstream side of the second intermediate feeding portion 31. The recording unit 4 includes a transporting unit 5, a recording head 42, a lower sheet guider 39, and a discharging unit 6. The transporting unit 5 includes a transportation driving roller 35 that is driven to rotate by the motor, and a transportation driven roller 36 that is pivotally supported by the upper sheet guider 37 so as to be driven-rotated while being brought into contact with the transporting roller 35. The sheet P that reaches the transporting unit 5 is precisely fed to a downstream side when the transportation driving roller 35 rotates while the sheet P is nipped between the transportation driving roller 35 and the transportation driven roller 36.

The recording head 42 is provided at a lower portion of a carriage 40. The carriage 40 is driven by a driving motor (not shown) to reciprocate in a main scanning direction while being guided by a carriage guiding shaft 41 that extends in the main scanning direction (a front and back direction of a paper surface in FIG. 1). In addition, the carriage 40 is so-called off carriage type on which an ink cartridge is not mounted. The ink cartridge (not shown) is provided independently from the carriage 40 and ink is supplied to the recording head 42 from the ink cartridge through an ink supplying tube (not shown).

The lower sheet guider 39 is provided at a position opposite to the recording head 42, and a distance between the sheet P and the recording head 42 is regulated by the lower sheet guider 39. In addition, the discharging unit 6, which discharges the sheet P after being recorded on, is provided at a downstream side of the lower sheet guider 39.

The discharging unit 6 includes a discharge driving roller 44 that is driven to rotate by a motor (not shown) and a discharge driven roller 45 that is driven-rotated while brought into contact with the discharge driving roller 44. The sheet P on which the recording is performed by the recording unit 4 is discharged onto the discharged sheet tray 66 of the sheet cassette 100 described later by the discharging unit 6.

Hereinbefore, an outline of the printer 1 is described. Hereinafter, the sheet cassette 100 will be described in more detail with also reference to FIGS. 2 to 4.

As described above, the upper stage side tray 60 is provided to be slidable with respect to the lower stage side tray 50, and the discharged sheet tray 66 is provided to be slidable with respect to the upper stage side tray 60.

In the printer 1 related to this embodiment, the upper stage side tray 60 and the discharged sheet tray 66 are configured to be driven by the driving unit 70.

More specifically, the driving unit 70 includes a driving pulley 72 as a "rotator", a first pinion gear 73, a second pinion gear 75, an endless belt 77, a driving gear 71, and a motor 79.

The driving pulley 72 is rotatably provided at a side surface of the lower stage side tray 50, and is provided to engage with the driving gear 71 provided at the side of the device main body 1*a* when the sheet cassette 100 is mounted in the device main body 1*a* of the printer 1. In addition, the driving gear 71 is driven by the motor 79 and this motor 79 is controlled by a controller 80.

Next, the first pinion gear 73 is provided to rotate around the same rotational axis as the driving pulley 72 at the side surface of the lower stage side tray 50, and is configured to rotate by obtaining power from the driving pulley 72 through a frictional force. That is, the driving pulley 72 is provided in a state of being tightly pressed to the first pinion gear 73 by a biasing unit (not shown), and therefore when the driving pulley 72 rotates, the first pinion gear 73 rotates by a frictional force between the driving pulley 72 and the first pinion gear 73.

In addition, since the first pinion gear 73 is connected to the driving pulley 72 through a frictional force, when a predetermined load or more is applied to the first pinion gear 73, the first pinion gear 73 does not rotate, and only the driving pulley 72 rotates.

Next, the second pinion gear 75 is rotatably provided at a position distant from the driving pulley 72 at the side surface of the lower stage side tray 50. The endless belt 77 is wound around and supported by a rotational shaft 75*a* provided to the second pinion gear 75 and the driving pulley 72, and therefore power is transmitted from the driving pulley 72 to the second pinion gear 75 to rotate the second pinion gear 75.

On the other hand, a rack portion 62 as a "first rack" is formed along a sliding direction of the upper stage side tray 60 at a lower side of the side surface of the upper stage side tray 60. The first pinion gear 73 engages with the rack portion 62 to make up an upper stage side tray driving portion 67 by a rack and pinion mechanism. In addition, a rack portion 66*a* as a "second rack" is formed along a sliding direction of the discharged sheet tray 66 at a lower side of a side surface of the discharged sheet tray 66. The second pinion gear 75 engages with the rack portion 66*a* to make up a rack and pinion mechanism.

According to this configuration as described above, in a state in which the sheet cassette 100 is mounted in the device main body 1*a* of the printer 1, when the sheet P1 is tried to be fed from the lower stage side tray 50 under the control of the controller 80, the upper stage side tray 60 is backwardly withdrawn with respect to the lower stage side tray 50 (a left side in FIG. 1) as shown in FIG. 2. In addition, the discharged sheet tray 66 is backwardly withdrawn with respect to the upper stage side tray 60.

Since the sheet P1 after being recorded on is discharged toward the discharged sheet tray 66 that is backwardly withdrawn as described above, the discharged sheet P1 after being recorded on is stacked on the discharged sheet tray 66. In addition, in this embodiment, a sheet longer than the upper stage side tray 60 is accommodated in the lower stage side tray 50, such that when the discharged sheet tray 66 is backwardly withdrawn sufficiently, the discharged sheet tray 66 can reliably receive the long sheet P1.

When the sheet P2 is fed from the upper stage side tray 60, as shown in FIG. 3, the upper stage side tray 60 moves until colliding with the front side (a right side in FIG. 1). In this state, the discharged sheet tray 66 also moves to the front side together with the upper stage side tray 60 (a magnitude of displacement of the upper stage side tray 60+a magnitude of displacement of the discharged sheet tray 66 with respect to the upper stage side tray 60). In this manner, the discharged sheet tray 66 is located at the front side (a depth direction of the device) in relation to a state shown in FIG. 2, but in this embodiment, the maximum length of the sheet P2 that can be accommodated in the upper stage side tray 60 is shorter than the maximum length of the sheet P1 that can be accommodated in the lower stage side tray 50, such that the sheet P2 that is fed from the upper stage side tray 60 and is discharged after being recorded on may be reliably received by the discharged sheet tray 66.

In a state in which the sheet cassette 100 is detached from the device main body, the upper stage side tray 60 and the discharged sheet tray 66 may be freely sliding-displaced by user's operation, such that as shown in FIG. 4, the sheet cassette 100 may be a completely closed state in which both of the upper stage side tray 60 and the discharged sheet tray 66 abut on the front side of the cassette.

In addition, when the sheet cassette 100 is mounted in the device main body 1*a* of the printer 1, a slidable range (displaceable amount) of the upper stage side tray 60 and a slidable range (displaceable amount) of the discharged sheet tray 66 are not necessarily coincident with each other, and in this embodiment, the slidable range of the discharged sheet tray 66 is larger than the slidable range of the upper stage side tray 60.

Therefore, for example, in a state in which the sheet cassette 100 is mounted, when the upper stage side tray 60 and the discharged sheet tray 66 are apt to be displaced from a state in which the upper stage side tray 60 and the discharged sheet tray 66 abut on the front side to the most to a state shown in FIG. 2, it is necessary to further slide-displace the discharged sheet tray 66 after the upper stage side tray 60 reaches a sliding limit. However, as described above, since power is transmitted from the driving pulley 72 to the first pinion gear 73 through a frictional force, even after the upper stage side tray 60 reaches the sliding limit, the driving pulley 72 can be made to rotate while maintaining the stopping state of the first pinion gear 73, such that the discharged sheet tray 66 can be slide-displaced. In addition, each magnitude of displacement of the upper stage side tray 60 and the discharged sheet tray 66 per unit amount of rotation of the motor 79 may be adjusted by adjusting a reduction ratio of the rack and pinion mechanism.

As described above, in the sheet cassette 100, since the discharged sheet tray 66 that is displaceable to a position where the discharged sheet after being recorded on is received is driven by the driving unit 70, it is possible to receive the discharged sheet by the discharged sheet tray 66 without needing a user's operation, such that it is possible to further improve the operability of the sheet cassette 100.

In addition, in this embodiment, since the driving unit 70 includes the upper stage side tray driving unit 67 that allows the upper stage side tray 60 to slide, and therefore the driving unit 70 allows the upper stage side tray 60 and the discharged sheet tray 66 to slide in conjunction with each other, it is possible to make a structure of a driving mechanism simple and thereby to configure the driving mechanism at a low cost compared to a case in which mechanisms, which independently drive the upper stage side tray 60 and the discharged sheet tray 66, are provided.

In addition, since the controller 80, which controls the motor 79, positions the discharged sheet tray 66 in response to a length of the sheet that is transmitted from the lower stage side tray 50 or the upper stage side tray 60, the discharged sheet tray 66 is positioned to an appropriate position in response to the length of the transmitted sheet, such that it is possible to appropriately receive the discharged sheet by the discharged sheet tray 66.

In addition, the first pinion gear 73 that drives the upper stage side tray 60 is configured to obtain power from the motor 79 from the driving pulley 72 through a frictional force, even when an amount of rotation that is necessary to the first pinion gear 73 driving the upper stage side tray 60 and an amount of rotation that is necessary to the second pinion gear 75 (driven by the driving pinion 72) driving the discharged sheet tray 66 are different from each other, the first pinion gear 73 may revolute with respect to the driving pulley 72, such that the difference in the amount of rotation may be absorbed.

In addition, in the above-described embodiments, the sheet cassette 100 is a two-stage type sheet cassette including the lower stage side tray 50 and the upper stage side tray 60, but the sheet cassette 100 is not limited to this, and may be configured in such a manner that a discharged sheet tray is driven by a driving unit in a one-stage type sheet cassette.

The entire disclosure of Japanese Patent Application No: 2011-020176, filed Feb. 1, 2011 is expressly incorporated by reference herein.

What is claimed is:

1. A recording device comprising:

a recording medium cassette that includes a lower stage side tray that accommodates a recording medium, an upper stage side tray that is slidable with respect to the lower stage side tray on an upper portion of the lower stage side tray and accommodates the recording medium, and a recording medium receiving member that is slidable with respect to the upper stage side tray on an upper portion of the upper stage side tray and is displaceable to a position to receive the recording medium discharged after being recorded on; and a driving unit which allows the recording medium receiving member to slide, wherein the driving unit is configured to allow the upper stage side tray and the recording medium receiving member to slide in conjunction with each other, wherein the driving unit includes:

a rotator from which the driving unit obtains power from a motor, a first pinion gear that engages with a first rack formed along a sliding direction of the upper stage side tray and obtains power from the rotator through a friction force, and a second pinion gear that engages with a second rack formed along a sliding direction of the recording medium receiving member, and obtains power from the rotator.

2. The recording device according to claim 1, wherein a controller, which controls the driving unit, positions the recording medium receiving member in response to a length of the recording medium that is transmitted from the lower stage side tray or the upper stage side tray.

* * * * *